United States Patent [19]

Arendt et al.

[11] 4,355,686

[45] Oct. 26, 1982

[54] WELL SYSTEM AND METHOD

[75] Inventors: Henry P. Arendt; Thomas J. Heard, both of Dallas, Tex.

[73] Assignee: Otis Engineering Corporation, Dallas, Tex.

[21] Appl. No.: 212,994

[22] Filed: Dec. 4, 1980

[51] Int. Cl.[3] ..... E21B 34/08

[52] U.S. Cl. ..... 166/313; 166/374; 166/318

[58] Field of Search ..... 166/313, 374, 373, 189, 166/317, 318

[56] References Cited

U.S. PATENT DOCUMENTS

| | | | |
|---|---|---|---|
| 3,306,365 | 2/1967 | Kammerer | 166/318 |
| 3,494,420 | 2/1970 | Sizer | 166/313 X |
| 3,552,491 | 1/1971 | Thompson | 166/313 X |

OTHER PUBLICATIONS

Composite Catalog of Oil Field Equipment and Services, 1972–1973, p. 3575; 1974–1975, p. 3949.

*Primary Examiner*—Ernest R. Purser

*Attorney, Agent, or Firm*—Vinson & Elkins

[57] ABSTRACT

A method and apparatus especially adapted for use with an injection well in which a valve controlled H-member interconnects the two tubings of a two tubing installation and landing nipples are attached to the lower legs of the H-member to receive expendable fluid control means, such as standing valves, in which pressure applied to one tubing to create a pressure differential will move the valve controlling the interconnection between the H-members to open position to permit TFL operations to be carried out in the well and thereafter pressure exerted on a ball supported on the valve member of the control valve for the H-member closes the control valve, and the ball passes through the control valve. The fluid control members in the landing nipples may be ejected either before or after closing of the valve in the H-member.

8 Claims, 3 Drawing Figures

WELL SYSTEM AND METHOD

This invention relates to method and equipment for use in wells and particularly for use in injection wells.

In some instances a formation is produced by injecting fluid into a well to cause the formation to be produced through other wells. The injected fluid may, in some instances, be liquid and, in some instances, be gas. In producing dual formations, fluid may be injected into the two formations through a single injection tubing or where conditions require fluid may be injected through two separate tubings.

Wells are now being completed in which it is desirable that all operations carried on in the well after completion utilize TFL (through flow line) procedures. Such procedures require that a connection be present between a pair of flow conduits and that the well system be capable of U-tubing fluid through the connection to cause the pumpdown equipment to move in either direction. Where fluid is injected into two formations under different conditions, this connection must be closed. The connection must be open during TFL procedures. Also, the outlet at the bottom of each tubing must permit injection of fluid into each formation and must be closed during U-tubing of TFL equipment.

Expendable flow control means for landing in a landing nipple are well known. While valve controlled H-members for interconnecting tubing are known (*Composite Catalog of Oil Field Equipment and Services* for 1972–1973, page 3575), all prior known H-members have disadvantages, especially when considered for application to injection wells.

An object of this invention is to provide a simple method and apparatus for controlling flow through the interconnection between the two legs of an H-member.

Another object is to provide a simple method and apparatus for converting a dual injection well from injection conditions to TFL operating conditions and then reconverting the well to injection conditions.

Another object is to provide a valve controlled H-member and expendable flow control means for controlling flow through the tubing below the H-member in which the dropping of a closure such as a ball and the manipulation of pressure within the two tubings is all that is required to convert the well from injection conditions to through flow line conditions and then reconvert the well to injection conditions.

Other objects, features and advantages of the invention will be apparent from the drawings, the specification and the claims.

In the drawings wherein like reference numerals indicate like parts, and wherein an illustrative embodiment of this invention is shown, FIG. 1 is a schematic view partially in elevation and partially in cross-section of a well equipped to practice this invention;

Figure 1:
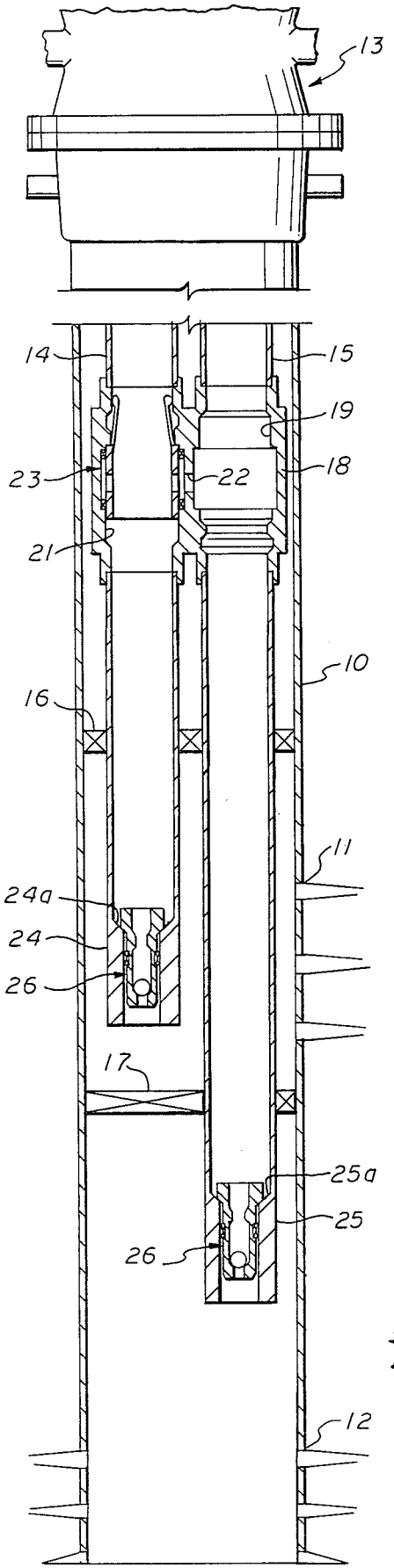

Referring to FIG. 1 an injection well is provided with a casing 10 perforated at 11 and 12 to provide for injecting fluids into two formations. The well has the usual wellhead indicated schematically at 13.

Within the well are suspended tubing 14 and 15 and suitable packers 16 and 17 pack-off between the two formations 11 and 12 and above formation 11.

Interconnecting the two tubings 14 and 15 is a H-member 18. This H-member has parallel bores 19 and 21 interconnected by a lateral passageway 22. The H-member carries a slide valve indicated generally at 23 for controlling flow through the lateral passageway 22.

Attached to the lower end of the H-member and in communication with the bores 19 and 21 are landing nipples 24 and 25. These landing nipples have no-go shoulders **24*a* and 25*a* adapted to support a flow control means such as the expendable standing valves indicated generally at 26**.

Figure 2:
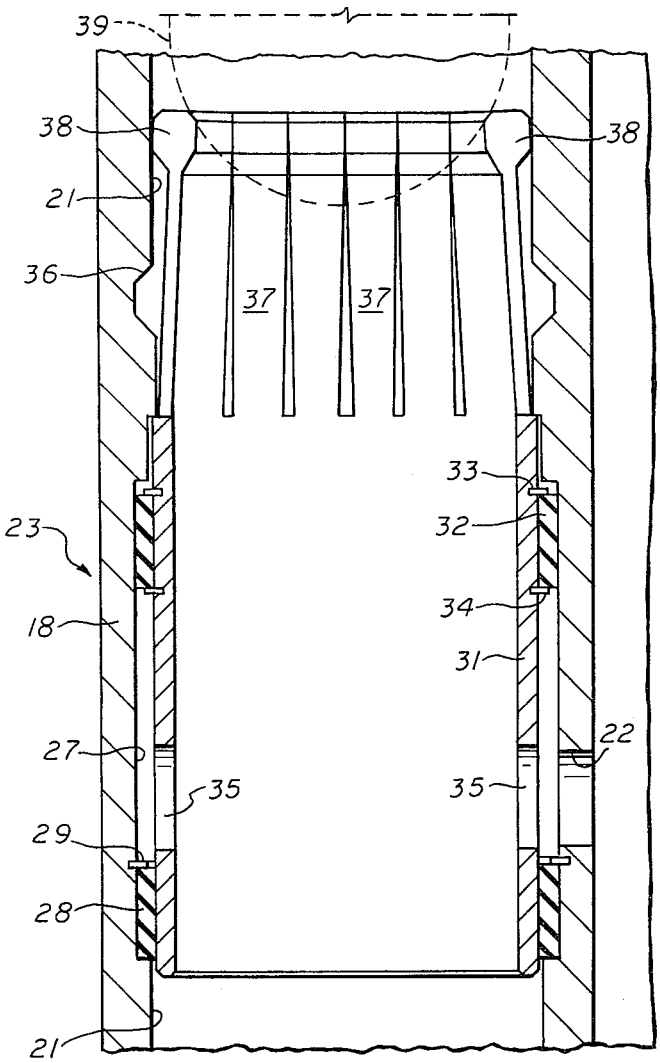
FIG. 2 is a fragmentary cross-sectional view on an enlarged scale showing the sleeve valve for the H-member and showing in dashed lines the lower section of a ball used in closing the valve.

Referring now to FIG. 2, there is shown a preferred form of valve 23 for controlling flow between the two tubings 14 and 15. This valve employs collets for supporting a pumpdown ball to move the collet downwardly as taught on Page 3949 of the 1974–1975 *Composite Catalog of Oil Field Equipment and Services.*

The H-member 18 has one bore such as bore 21 enlarged as at 27. Within the bore there is positioned a seal 28 held in place by a C-ring 29.

Within the bore 21 there is positioned a sliding valve member 31 which sealingly engages seal 28 and carries seal 32 held in place by upper and lower C-rings 33 and 34. The seal member 32 slides within and is sealingly engaged with the enlarged bore 27. The valve member 31 is provided with ports 35 which register with the enlarged bore 27 when the valve member is in the upper position. These ports 35 are positioned below the seal member 28 when the valve 31 is in its lower position to control flow through the interconnecting passageway 22 within the H-member 18. When the valve is closed a selected differential between tubing 15 and 14 will exert a force upon the seal member 32 and when the pressure in tubing 15 is sufficiently greater than the pressure in tubing 14, the sliding valve member 31 will be moved to its upper position due to the effect of pressure on the pressure responsive area provided by the difference in diameter of the enlarged bore 27 and the outer diameter of the slide valve 31.

In the bore 21 and above the enlarged area 27, a circumferential groove 36 is provided. This groove 36 and the bore 21 thereabove cooperate with collet fingers 37 having enlarged lugs 38 on the free end thereof. When the sliding valve 31 is in its upper position, the collet fingers 37 are collapsed inwardly by the wall providing bore 21 and the fingers provide a circumferential shelf on which the pumpdown ball 39 may be landed.

As will be understood by those skilled in the art, the spaces between the lugs 38 on the collet fingers 37 may be dimensioned to be of close tolerance or provided with resilient material to restrict or prevent flow therethrough and/or the ball 39 may be made of resilient material or have a hard core with a resilient cover to inhibit or prevent flow of fluid through the collet fingers when the ball 39 is seated on the fingers.

In the operation of the slide valve an increase in pressure in tubing 15 to a selected value over the pressure in tubing 14 results in an upward force being exerted on the valve 31 to force the lugs 38 on the collet fingers from groove 36 to move the valve to its upper position as shown. In this position the collet fingers are retracted. When it is desired to close the valve, a ball 39 is dropped into tubing 14 and pressure is exerted in tubing 14 to move the ball downwardly and close the slide valve 23. When the valve closes the lugs 38 expand into groove 36 and permit the ball 39 to fall through the slide valve member 31. The lugs hold the slide valve in closed position.

Figure 3:
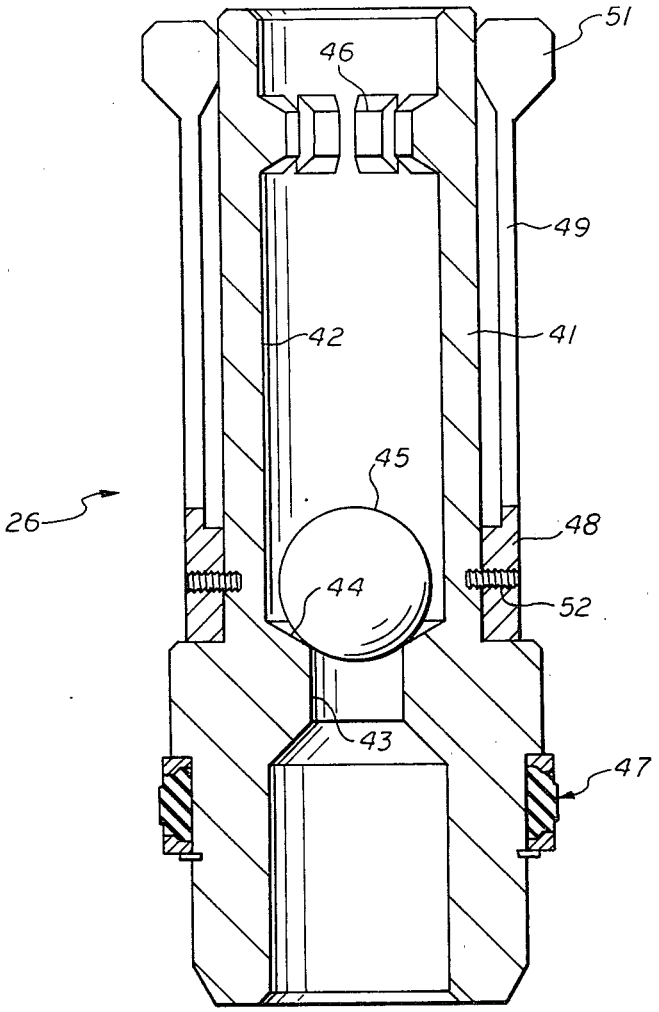
FIG. 3 is an enlarged view in cross-section of an expendable standing valve.

There is shown in FIG. 3 a form of flow control means 26 which may be utilized with this invention. While any desired flow control means may be employed, a standing valve is preferred.

The standing valve 26 includes a mandrel 41 having a flowway 42 therethrough with a reduced diameter section 43 providing a seat 44. Within the flowway 42 and above seat 44 is the ball 45 which cooperates with seat 44 to control flow through the flowway. A suitable cage 46 retains the ball 45 in flowway 44.

On the exterior of the mandrel there is provided a suitable seal 47 for sealing between the standing valve and the landing nipple 24 or 25.

A collet 48 is slidably mounted on the upper section of the mandrel 41. The collet 48 has collet fingers 49 and enlarged lugs 51 on the free end of the collet fingers.

The collet is secured to the mandrel 31 in any suitable releasable manner as by shear pins 52.

The expendable standing valve is sized to pass through the sliding valve 23 in the H-member. The relative sizes of the bores through the sliding valve 23 and the landing nipple 24 and 25 are such that while the lugs on the standing valve will pass through the sliding valve 23, they will land upon the no-go shoulders **24*a* and 25*a* in the landing nipples. When suitable downward force is exerted by a selected pressure acting downwardly on the standing valves, the pins 52 will shear and the mandrel 41 will be driven downwardly under pressure to unprop the collet lugs 51**. These lugs will then contract to their normal unstressed condition at which time they will be less in diameter than the bore through the landing nipple and the standing valves will be expelled from the landing nipples.

The landing nipples are shown to be conventionally placed at the lower end of each tubing, but it will be understood that they could be placed immediately below the H-member or the H-member could be formed to provide no-go surfaces at its lower ends which would act as landing nipples. The conventional arrangement shown is preferred and the standing valves will be expelled directly into the open casing.

In practicing the method of this invention the well will be used as an injection well in which fluids are injected and production occurs in adjacent wells. When for some reason it is desired to carry out TFL operations in the well, injection of fluid is stopped and the well is placed in condition for TFL operations.

After injection of fluid is stopped the expendable flow control means, such as the standing valves 26, are dropped into each of tubings 14 and 15 and landed in the landing nipples 24 and 25 in the conventional manner.

Pressure in tubing 15 is now increased to a selected value over pressure within tubing 14. This pressure is effective on the pressure responsive area provided by seal 32 on valve member 31 to overcome the resistance of collet fingers 38 residing in groove 36 and force the valve member 31 to its full up position, as shown in FIG. 2. At this time the lower end of each of tubings 14 and 15 are blocked to downward flow and the H-member sliding valve 23 is in open position providing for communication between the two tubings 14 and 15. This permits a U-tubing of fluid in the tubings 14 and 15 to move TFL tools up and down the tubing to carry out any desired TFL procedures.

After TFL tools have been removed from the well, the well may be returned to fluid injection conditions to continue normal operations. Where it is desired to inject separate fluids or fluids at different conditions, such as pressure, temperature, etc., the slide valve 23 should be closed. For this purpose a ball, such as ball 39, is dropped into tubing 14 and landed on the collet fingers 37 of the slide valve. A downward force is then exerted across the ball at 39 by increasing pressure within tubing 14 to a selected value greater than the pressure within the interconnecting passageway 22 to move the slide valve 31 downwardly to closed position and the passageway 22 is closed to flow of fluids. In this position the lugs 38 will expand into groove 36 to latch the valve member in fully closed position. The ball 39 will drop through the slide valve.

The expendable flow control means 26 may be removed from the landing nipples 24 before or after the slide valve 23 is closed.

The standing valves are removed by pressuring up tubings 14 and 15 to a selected pressure at which shear pins 52 fail and the standing valves are ejected downwardly from the landing nipples.

If it is desired to first close the slide valve 23, the ball 39 is dropped and pressure in tubing 14 is increased to a selected value over that of tubing 15, but less than the pressure needed to eject the standing valves. This selected pressure will result in closing of the slide valve as above discussed. Thereafter, the pressure in tubing 15 may be increased to a value at which the pin shears in the standing valve in the lower end of tubing 15 while the differential in pressure between tubings 14 and 15 is carefully maintained to be less than that required to open the slide valve 23 but to be greater enough to shear the pin in the standing valve in the landing mandrel 25 without shearing the pin in the valve in mandrel 14. Thereafter, the pressure within tubing 14 may be increased to a value to eject the standing valve in the landing nipple 24.

With the slide valve open the order of ejection of the slide valve will be controlled by the shear valve of the shear pins in the standing valves. In order to insure that the standing valve in tubing 15 will always first be ejected, the shear value of the shear pins 52 may be less in this standing valve than in the standing valve landed in landing nipple 24 and the standing valve in the tubing 15 will always be ejected first and the slide valve 23 can thereafter be closed and the standing valve in the tubing 14 thereafter ejected.

The method and apparatus of this invention may be employed with flow control means, such as standing valves, in which upon increase in pressure in both tubings to a selected value a shear pin is sheared in the standing valves without ejecting the standing valves. Thereafter, while continually maintaining pressure in the tubings to maintain the standing valves in place a differential may be imposed to close valve 23. After the valve 23 is closed, pressure is removed from the tubings and the standing valves either drop out at this time or upon the next application of pressure to the tubings. See the application of M. D. Kilgore, filed on even date herewith for a disclosure of such a valve.

The foregoing disclosure and description of the invention are illustrative and explanatory thereof and various changes in the size, shape and materials, as well as in the details of the illustrated construction, and in the process may be made within the scope of the appended claims without departing from the spirit of the invention.

What is claimed is:

1. The method of operating an injection well having a pair of tubing, an H-member in said pair of tubing with a pair of bores interconnected by a lateral passageway and a normally closed sliding sleeve valve in one bore controlling flow through said lateral passageway, and landing nipples connected to each lower leg of the H-member, comprising, landing a fluid control means in each landing nipple, establishing a selected differential across said interconnecting means to move said sleeve valve upwardly to open position, carrying out TFL procedures in said pair of tubing, landing a plug in the valve member of said sleeve valve, and establishing a selected pressure differential across said plug to close said sleeve valve and pump said plug through said sleeve valve.

2. The method of claim 1 wherein one or more of the fluid control means are ejected after said sleeve valve has been closed.

3. The method of claim 1 wherein one of said fluid control means is ejected before said sleeve valve is closed.

4. The method of claim 1 wherein after said plug is landed and prior to closing said sleeve valve a selected pressure differential is maintained between said two tubings which is less than that required to open the slide valve while pressure is increased in the other tubing to a value at which the fluid control means in said tubing is ejected, thereafter closing said slide valve and thereafter ejecting the fluid control means in the tubing containing said slide valve.

5. Apparatus comprising, an H-member having a pair of bores therethrough interconnected by a lateral passageway, a sliding sleeve valve in one of said bores controlling flow through said lateral passageway, said valve having a valve member with a pressure responsive area exposed to said lateral port shifting said valve member upwardly to open position in response to pressure in said lateral passageway exceeding pressure within said sliding sleeve valve by a selected amount, a circumferential groove in said one bore, collet fingers carried by said valve member and positioned in said groove when the valve member is closed and resisting movement of said valve member to open position, said collet fingers when collapsed inwardly by movement of said valve member to open position providing a circumferential surface upon which a ball may be landed and pumped downwardly to move the valve member to open position.

6. The apparatus of claim 5 in combination with, a landing nipple having a no-go shoulder secured to each of the lower two legs of the H-member, and expendable fluid control means supported on each no-go shoulder.

7. Apparatus comprising, an H-member having a pair of bores therethrough interconnected by a lateral passageway, a sliding sleeve valve in one of said bores controlling flow through said lateral passageway, means for moving the valve member of said sliding sleeve valve upwardly to open position in response to a selected differential in pressure in said other bore greater than the pressure in said one bore, and means responsive to a force exerted by a member being pumped downwardly in said one bore for moving said valve member to closed position.

8. The apparatus of claim 7 in combination with, a landing nipple having a no-go shoulder secured to each of the lower two legs of the H-member, and expendable fluid control means supported on each no-go shoulder.

* * * * *